US006158598A

United States Patent [19]

Josefsson

[11] Patent Number: 6,158,598

[45] Date of Patent: Dec. 12, 2000

[54] BIASED PUSHER MOUNTABLE ON A DISPLAY HOOK

[75] Inventor: Börje Josefsson, Sundsvall, Sweden

[73] Assignee: HL Display AB, Stockholm, Sweden

[21] Appl. No.: 09/029,366

[22] PCT Filed: Jun. 26, 1997

[86] PCT No.: PCT/SE97/01151

§ 371 Date: Nov. 5, 1998

§ 102(e) Date: Nov. 5, 1998

[87] PCT Pub. No.: WO98/01062

PCT Pub. Date: Jan. 15, 1998

[30] Foreign Application Priority Data

Jul. 4, 1996 [SE] Sweden ..... 9602651

[51] Int. Cl.[7] ..... B42F 7/00; A47F 1/04

[52] U.S. Cl. ..... 211/54.1; 211/59.1; 211/57.1; 211/59.3

[58] Field of Search ..... 211/54.1, 51, 57.1, 211/59.1, 59.2, 59.3, 106; 248/220.21, 220.31, 220.41, 220.42

[56] References Cited

U.S. PATENT DOCUMENTS

| | | | |
|---|---|---|---|
| 1,429,277 | 9/1922 | Dudek | 211/51 |
| 1,494,115 | 5/1924 | Isham | 211/54.1 |
| 2,939,619 | 6/1960 | Levesque | 211/51 |
| 3,028,014 | 4/1962 | Southwick | 211/59.3 |
| 3,166,195 | 1/1965 | Taber | 211/59.4 |
| 3,785,501 | 1/1974 | Canning | 211/7 |
| 3,827,569 | 8/1974 | Canning | 211/7 |
| 3,986,614 | 10/1976 | Fernandez-Rana et al. | 211/51 |
| 4,474,300 | 10/1984 | Entis | 211/57.1 |
| 4,475,658 | 10/1984 | Roberts | 211/54.1 |
| 4,706,821 | 11/1987 | Kohls et al. | 211/59.3 |
| 4,742,936 | 5/1988 | Rein | 211/59.3 |
| 4,821,894 | 4/1989 | Dechirot | 211/59.3 |
| 5,009,334 | 4/1991 | Bodkins | 211/57.1 |
| 5,114,021 | 5/1992 | Fredrickson . | |
| 5,123,546 | 6/1992 | Crum | 211/59.3 |
| 5,222,608 | 6/1993 | Eklof et al. | 211/57.1 |
| 5,307,941 | 5/1994 | Siegal | 211/59.3 |
| 5,485,929 | 1/1996 | Danon | 211/57.1 |
| 5,671,851 | 9/1997 | Johnson et al. | 211/57.1 |
| 5,718,340 | 2/1998 | Nagel | 211/57.1 |
| 5,730,320 | 3/1998 | David | 211/59.3 |

FOREIGN PATENT DOCUMENTS 2527913 12/1983 France .

*Primary Examiner*—Jerry Redman
*Assistant Examiner*—Jennifer E. Novosad
*Attorney, Agent, or Firm*—Ostrolenk, Faber, Gerb & Soffen, LLP

[57] ABSTRACT

An arrangement for display hooks (2) mountable on a support comprising a cantilevered arm (5) for carrying the articles. The arrangement includes a spring biased pusher (1), the spring (7) causing the pusher to move along the display hook (2) towards the free end (6) thereof, the pusher (1) being intended to urge the articles suspensed from the arm (5) towards a given position at the free end (6) thereof, such as to effect favorable presentation of the articles.

9 Claims, 3 Drawing Sheets

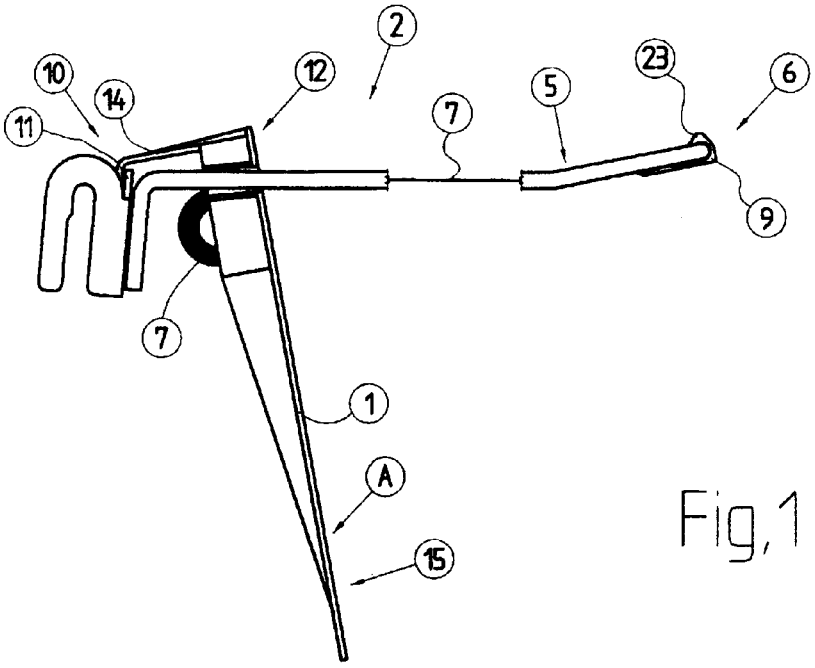
Fig,1
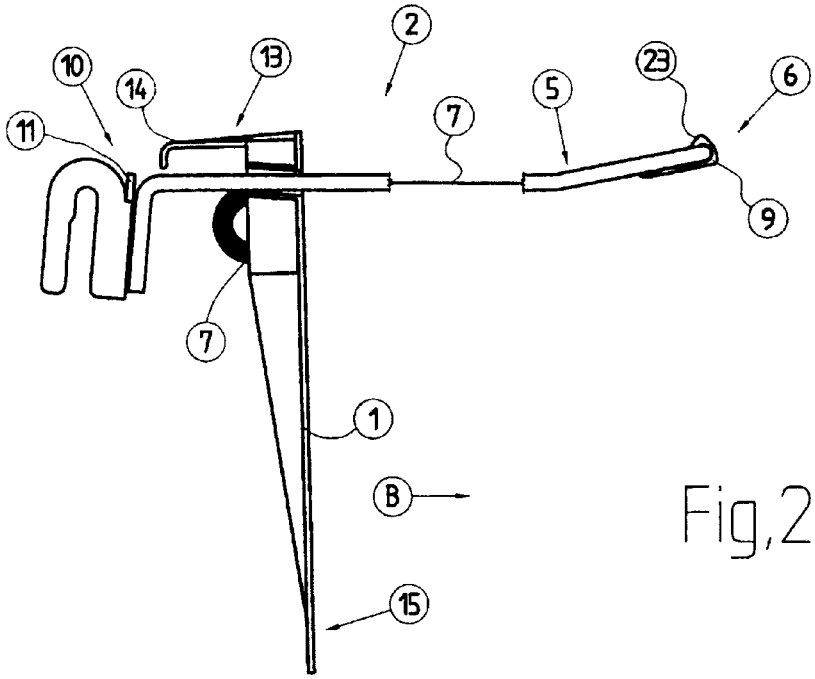
Fig,2

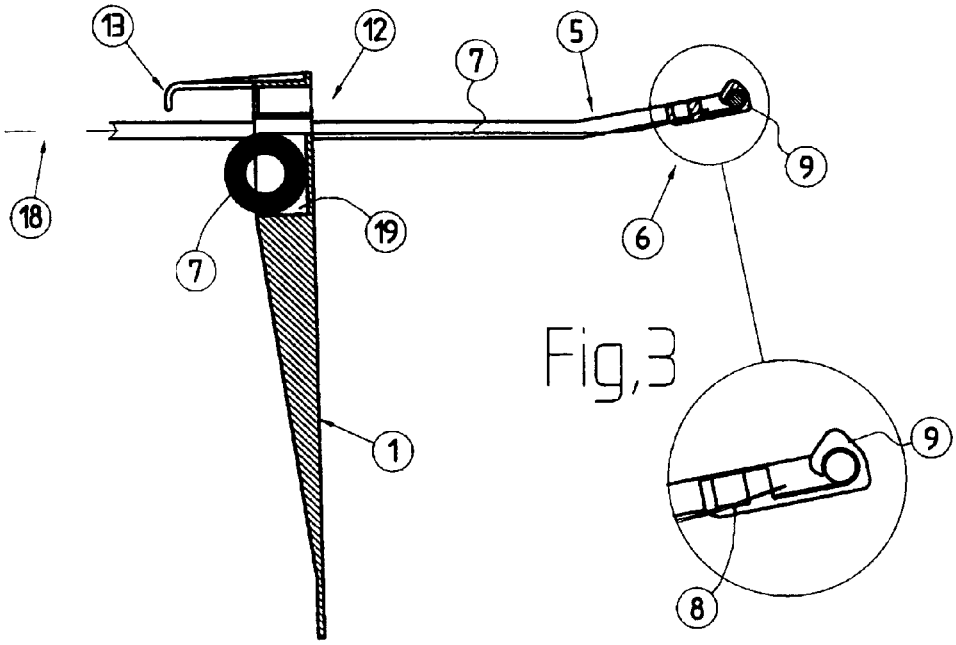
Fig,3
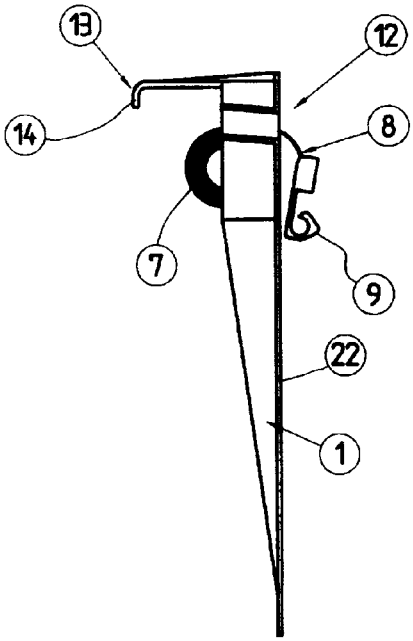
Fig,4
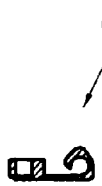
Fig,10
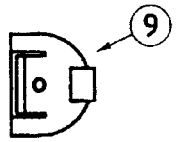
Fig,9

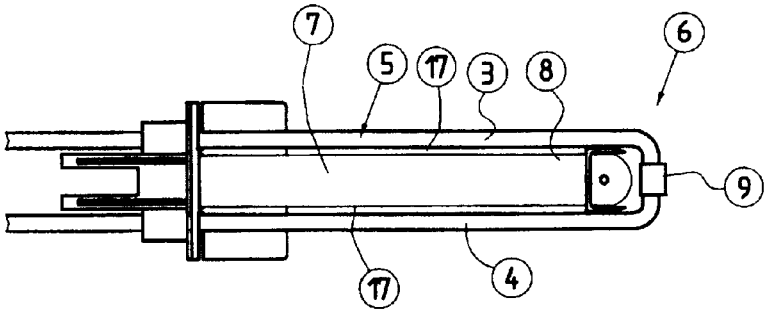
Fig,5
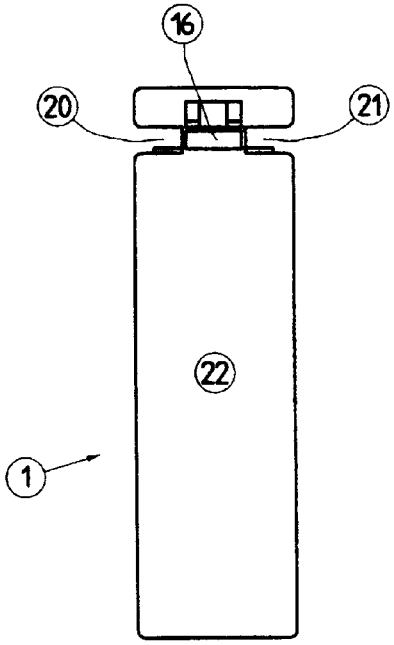
Fig,6
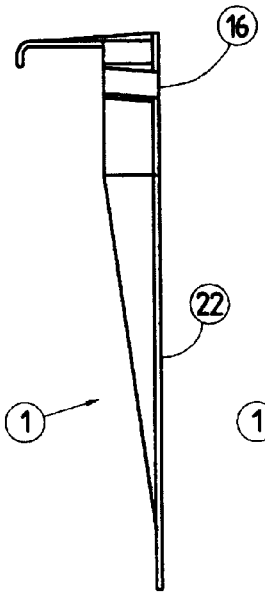
Fig,7
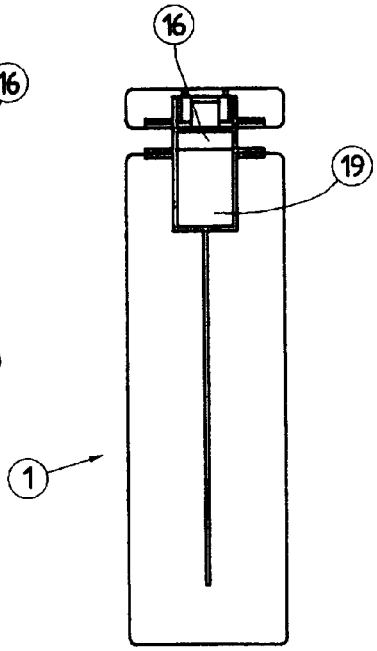
Fig,8

BIASED PUSHER MOUNTABLE ON A DISPLAY HOOK

BACKGROUND OF THE INVENTION

1. Field of the Invention

The present invention relates to an arrangement for a display hook comprising a cantilevered arm and mounted on a suitably arranged support means, such as a stand, a shelf or the like and intended for exposing articles or merchandise in shops, stores, etcetera.

2. Description of the Related Arts

The display hooks used for this purpose today are usually burdened with the disadvantage that, when most of the articles on the hook have been taken, it is difficult for a person to find those remaining, since several hooks with different articles hanging from them are most often placed close together. It has thus long been a desire that the foremost of the articles on a hook is always as far forward as possible, even when there are only a few articles hanging on the hook, thus facilitating article selection.

SUMMARY OF THE INVENTION

An object of the invention is to provide an arrangement in display hooks carrying articles, where the presentation of them is always very favourable, since each article is always in the most outward position on the hook when it is taken.

This inventive object is attained with a display hook of the kind mentioned in the introduction, when it is provided, in accordance with the invention, with a device including a spring, which urges articles towards the end of the hook as each article is removed. Thus, the remaining articles are always as far forward on the hook as is possible. The distinguishing features of the invention are disclosed in the accompanying claims.

As a result of the invention, there has now been achieved an arrangement and a device for a display hook of the kind mentioned, which admirably fulfils the purposes, while being both cheap and simple to implement. The device mainly comprises a pusher suspended from the display hook, and with the aid of spring bias it constantly urges articles on the hook towards the free end thereof as each article is taken off. So that articles will not slide off the hook, its free end may also be provided with an arresting means for preventing them from coming off too easily. The function of the inventive device included in the arrangement is guaranteed by the use of a spring having the correct bias, i.e. one that is suited to article number, weight, and friction against the hook. In addition, the spring is progressive, i.e. having its greatest bias when fully extended, this bias decreasing as the distance from spring to hook end decreases. There is also provision for positionally fixing the pusher to the hook when the spring is fully extended, this being provided at the means attaching the hook to a backboard or the like. This arrangement facilitates refilling the hook with more articles when it has been emptied. In the position just mentioned, the angle between pusher and hook is some few degrees less than 90° on the outward side of the pusher. When a new lot of articles is put on the hook a slight pressure towards the backboard, on the lower part of the pusher, releases its fixation and enables it to push the articles forward to the free end of the hook. A further prominent advantage with the invention is that the device may be fitted to existing hooks.

BRIEF DESCRIPTION OF SEVERAL VIEWS OF THE DRAWINGS

The invention will now be described in detail with the aid of a preferred embodiment, and with reference to the accompanying drawings, where:

FIG. 1 is a schematic side view of a preferred embodiment of the inventive arrangement with the inventive pusher fitted to a display hook. The pusher is shown fixed in latched position appropriate to putting a new lot of articles on the hook, FIG. 2 is the same view as in FIG. 1, but with the pusher released from its fixed or latched position, such as to allow it to push articles suspended from the hook towards the free end thereof with the aid of spring bias, FIG. 3 is a schematic side view, partially in section, of the arrangement illustrated in FIG. 2, showing the position of the spring in the device and how the tip of the spring is held by its retainer at the free end of the hook, FIG. 4 is a side view of the inventive device by itself, FIG. 5 is a view from above of the arrangement in FIG. 3, FIG. 6 is a front view of the device by itself, FIG. 7 is a side view of the device in FIG. 6, FIG. 8 is a rear view of the device in FIGS. 6 and 7, FIG. 9 is a view from above of the spring end retainer, the spring end not being shown in its fastened state, and FIG. 10 is a cross-section of the retainer in FIG. 9.

As will be seen from the embodiment illustrated in the drawings, the inventive arrangement includes a pusher 1, which may be fitted to a display hook 2 for presenting goods or articles in shops and the like. The hook 2 is intended to be supported by a stand, shelf, backboard or the like. In the illustrated example the hook 2 comprises two mutually parallel wires 3, 4 forming a cantilevered arm 5, which may be slightly bent upwards at its free end 6, as will be apparent from FIGS. 1–3.

As best seen from these two figures, the pusher 1 is movably and dependently arranged between the wires 3 and 4 on the arm 5, and is automatically urged towards the hook free end 6 with the aid of a spring 7. The latter is preferably a tension spring having its free end 8 fastened to the arm free end 6 with the aid of a spring retainer 9. The bias of the spring is used to cause the pusher 1 to push the articles suspended on the arm 5 forwards to a given position at its outward end 6 for achieving favourable presentation of the articles. The spring 7 is accommodated in a recess 19 in the pusher 1, and is wound or unwound depending on the direction of movement of the pusher 1. Preferably, a spiral spring is used, with a bias adjusted to the quantity, weight and friction against the arm 5 of the articles. The spring is also progressive, i.e. it has its greatest bias when fully extended, bias decreasing as it winds up, i.e. as the pusher 1 moves towards the tip or free end 6 of the arm 5.

In the region of its means of attachment to a backboard or the like, the arm 5 is provided with a latching means 10, comprising such as a transverse member 11 fixed to the backboard attachment means and/or the wires 3, 4. Also included in means 10 is a latching means 13, with its dependent end lock portion 14 coacting with member 11 for latching or fixing the pusher 1 at its inward end position with spring 7 fully extended. This coaction takes place when the lower end of the pusher is lifted slightly so that it is at an angle of somewhat less than 90° to the arm 5. Articles are then readily put on the arm 5, subsequent to which the latch is released by pressing the lower end portion 15 of the pusher 1 in the direction of arrow A towards the backboard or the like. The pusher 1 is now able, with the aid of bias from the spring 7, to push the articles along the arm 5 in the direction of arrow B towards the free end 6 of the arm 5. As will be seen from the figures, the lock portion 14 of the latching means 13 is easily latched to the member 11 when the pusher 1 is slightly angled, and by this arrangement positional fixation of the pusher 1 is just as readily activated or deactivated in connection with, or after filling articles on to the hook arm 5.

As will best be seen from FIGS. 3, 6 and 8 the spring 7 extends from its recess 19 in the pusher 1 through an opening 16, and is extensible against its bias, which urges it to contract. In the illustrated example the recess is on level with a space 17 between the wires 3, 4 and disposed about their centre-line 18.

The configuraton of pusher 1 is best seen in FIGS. 6–8. At its upper portion 12 the pusher is provided with mutually opposing recesses 20, 21, which have a shape intended to accommodate wires 3, 4, the opening 16 being situated between them. In FIG. 4 the pusher is illustrated by itself, with the spring 7 in its retracted or wound-up state and the spring retainer 9 loosely dependent.

In FIGS. 9 and 10 there are respectively shown a view from above of the retainer 9 and a cross-section through it, the retainer being intended for fastening to the free outer end 8 of the spring 7.

The pusher 1 is slipped between the two wires 3, 4 of the hook 2 and turned 90°, so that its smooth face 22 engaging against suspended articles is directed towards the free end 6 of the hook 2. When the pusher 1 has been fitted to the hook 2 the spring 7 is pulled out and spring retainer 9 is snapped round the free end 6 formed by the wires 3, 4. The retainer 9 may also be provided with an arresting hump 23, as will be seen from FIGS. 1–7, for preventing articles sliding too easily off the hook. Using the method described above for fitting the pusher 1 to the hook 2, the former can also be fitted using simple hand movements to hooks already in use, which has not been possible with previously known solutions for similar configurations.

What is claimed is:

1. Arrangement for display hooks, which may be mounted on support means for presenting articles, comprising a cantilevered arm having a free end including two mutually adjacent and parallel horizontally-arranged wires for suspending the articles, the arrangement also including a pusher having a lower portion and an upper portion displaceable along the arm and biased by a spring in a direction towards the free end of the arm such as to push the articles suspended from the arm in a forward direction to a given position at its free end, for achieving favourable presentation of the articles, wherein the pusher is adapted to be carried by the wires, and suspended therebetween, with open recesses at the upper portion of the pusher receiving said wires.

2. Arrangement as claimed in claim 1, further comprising means for attaching said arrangement to an object, comprising a latching means and a second latching means disposed on the arm, including a transverse member intended for coaction with a lock portion of the latching means in the upper portion of the pusher for latching the pusher in an inward end position, with the spring fully extended, said arm being receivable of articles for display.

3. Arrangement as claimed in claim 2, wherein the lock portion is an open hook configuration, permitting latching onto the transverse member when the pusher is angled.

4. Arrangement as claimed in claim 1, wherein in the region of its attachment to the arm the pusher is provided with a recess in its side facing away from its pushing face, which is directed towards the free end of the arm, this recess accommodating the spring, which is extendable through an opening of the arm substantially level with the wires forming the arm.

5. Arrangement as claimed in claim 1, wherein a free end of the spring can be locked in a spring retainer, which in turn may be snapped over the free end of the arm.

6. Arrangement as claimed in claim 5, wherein the spring retainer is provided with an arresting hump for preventing articles from undesired sliding off the display hook.

7. Arrangement as claimed in claim 1, wherein the spring is a tension spring adapted to contact the pusher, and having a free end restrained at a free end of the arm forming the display hook.

8. Arrangement as claimed in claim 1, wherein the spring has a spring bias appropriate for biasing a number, weight and friction against the display hook of the articles suspended from said display hook.

9. Arrangement as claimed in claim 1, wherein the spring has a bias being greatest when the spring is extended, such as to become weaker as it contracts or winds up.

* * * * *